US006414664B1

(12) United States Patent
Conover et al.

(10) Patent No.: US 6,414,664 B1
(45) **Date of Patent: *Jul. 2, 2002**

(54) METHOD OF AND APPARATUS FOR CONTROLLING CONTRAST OF LIQUID CRYSTAL DISPLAYS WHILE RECEIVING LARGE DYNAMIC RANGE VIDEO

(75) Inventors: Kurt M. Conover, Albuquerque; Teddy J. Wood, Corrales, both of NM (US)

(73) Assignee: Honeywell Inc., Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/970,118

(22) Filed: Nov. 13, 1997

(51) Int. Cl.[7] ..... G09G 3/36
(52) U.S. Cl. ..... 345/89; 348/673; 348/678
(58) Field of Search ..... 345/87–101, 150; 358/457, 456, 455, 426, 448; 378/58, 22, 62; 348/30, 671–686; 395/500, 84

(56) References Cited

U.S. PATENT DOCUMENTS

| | | | | |
|---|---|---|---|---|
| 4,827,255 A | * | 5/1989 | Ishii | 345/148 |
| 5,088,806 A | | 2/1992 | McCartney et al. | 359/84 |
| 5,109,278 A | * | 4/1992 | Erickson et al. | 345/153 |
| 5,155,588 A | * | 10/1992 | Levien | 358/80 |
| 5,196,839 A | * | 3/1993 | Johary et al. | 345/148 |
| 5,206,633 A | * | 4/1993 | Zalph | 345/92 |
| 5,250,937 A | | 10/1993 | Kikuo et al. | |
| 5,317,400 A | * | 5/1994 | Gurley et al. | 348/679 |
| 5,422,680 A | * | 6/1995 | Lagoni et al. | 348/674 |
| 5,488,391 A | | 1/1996 | Favot et al. | |
| 5,515,074 A | | 5/1996 | Yamamoto | 345/101 |
| 5,664,158 A | | 9/1997 | Larimer | 395/500 |
| 5,796,384 A | * | 8/1998 | Kim | 345/147 |
| 5,841,418 A | * | 11/1998 | Bril et al. | 345/3 |
| 5,841,439 A | * | 11/1998 | Pose et al. | 345/418 |
| 5,949,393 A | * | 9/1999 | Sakai et al. | 345/74 |
| 5,953,002 A | * | 9/1999 | Hirai et al. | 345/204 |
| 6,043,797 A | * | 3/2000 | Clifton et al. | 345/1.1 |

FOREIGN PATENT DOCUMENTS

| | | |
|---|---|---|
| EP | 0513551 A2 | 11/1992 |
| EP | 0516083 A2 | 12/1992 |
| EP | 0599339 A2 | 6/1994 |
| EP | 0745969 A3 | 12/1996 |
| EP | 0745969 A2 | 12/1996 |
| JP | 06233131 | 8/1994 |

OTHER PUBLICATIONS

IBM Technical Disclosure Bulletin, vol. 36, No. 05, May 1993.*

* cited by examiner

*Primary Examiner*—Steven Saras
*Assistant Examiner*—Amr Awad
(74) *Attorney, Agent, or Firm*—Loria B. Yeadon; William C. Anderson

(57) ABSTRACT

An apparatus and method for controlling contrast for a liquid crystal display ("LCD"), especially active-matrix LCDs, while receiving large dynamic range video data to be displayed to the user by the LCD. Contrast settings of the LCD correspond to a single look-up table from a set of different and multiple look-up tables rather than using the contrast setting of the LCD to select different voltage values from a single look-up table. The values of the reference voltages of the LCD are varied so that all shades of gray are available with each contrast selection resulting in a high image quality and a high contrast.

33 Claims, 6 Drawing Sheets

METHOD OF AND APPARATUS FOR CONTROLLING CONTRAST OF LIQUID CRYSTAL DISPLAYS WHILE RECEIVING LARGE DYNAMIC RANGE VIDEO

GOVERNMENT RIGHTS

The United States Government has acquired certain rights in this invention through Government Contract No. F33657-90-C-2233 awarded by the U.S. Department of the Air Force.

CROSS-REFERENCE TO RELATED APPLICATIONS

Not applicable.

BACKGROUND OF THE INVENTION

The present invention relates generally to the field of display devices such as liquid crystal display ("LCD") devices and the like. More specifically, the present invention relates to a method of and apparatus for controlling contrast for such LCDs, especially active-matrix LCDs, while receiving large dynamic range video data.

An "image" is a pattern of physical light. An "image output device" is a device that can provide an output defining an image. A "display" is an image output device that provides information to an observer in a visible form. A "liquid crystal display" ("LCD") is a display device that includes a liquid crystal cell with a light transmission characteristic that can be controlled in parts of the cell by an array of light control units to cause presentation of an image. A "liquid crystal cell" is an enclosure containing a liquid crystal material. An "active-matrix liquid-crystal display" ("AMLCD") is an LCD in which each light control unit has a nonlinear switching element that causes presentation of an image segment by controlling a light transmission characteristic of an adjacent part of the liquid crystal cell. An LCD can have a plurality of electrically-separated display regions, each display region also being known as a display cell, or when the regions designate a small portion of the display, each display region is known as a "pixel." Each pixel in a high density display matrix, such as for LCDs, requires its own active (switching element) driver (e.g., a thin film transistor). The light control units can, for example, be binary control units.

In recent years, due to the great needs of avionics displays, LCD devices are more popularly used in avionics displays than other solid image display elements because of the low power consumption of the LCD elements. Also, personal computers, portable game machines, and other devices requiring a visual interface often use LCDs to display data. Such LCDs can be matrix addressed, such as an active-matrix LCD, but the use of a thin film transistor with every pixel in an active-matrix LCD is required for high resolution. Recently, color LCDs have come into common usage also. The increased usage of the color LCDs is partially because of their availability and a color pixel density of 100 to the inch can be easily achieved.

LCDs are generally classified into two categories: passive-matrix LCDs and active-matrix LCDs. Active-matrix LCDs are more popular than passive-matrix LCDs because of their excellent image quality, high speed, high contrast ratio (i.e., ratio of maximum to minimum luminance values in the LCD), and superior color quality. Although the passive-matrix LCDs are advantageously used for high-density integration because of their simple structures and lower manufacturing costs, the passive-matrix LCD elements have crosstalk to a non-selected cell, and an increase in resolution, which is an object of the high-density integration, cannot be achieved. In contrast to this, in the active-matrix LCDs, crosstalk to a non-selected cell can be suppressed without posing any problem, and an image having a high resolution can be obtained, thereby considerably improving image quality. In this manner, a large number of active-matrix LCDs have been used in recent years. Also, passive-matrix and active-matrix LCDs operate with a back light, which is typically a fluorescent lamp.

Both the active-matrix and passive-matrix LCDs are a matrix of row and column electrodes with a pixel at the intersection of each row and column. The active-matrix LCD provides a transistor at the intersection of each row and column electrode to greatly improve the voltage control of each pixel. The LCD is driven by providing the video voltage to the pixels one row at a time. The LCD is refreshed at a frequency that minimizes the flicker of the LCD, typically greater than 30-Hz. In a typical LCD architecture, the row electrodes are used to select the row which is to be driven and the column electrode provides the drive voltage that is used to determine the gray shade or level of the pixel at the intersection of the selected row and column. In a passive-matrix LCD, the root-mean-square voltage across the pixel, as determined by the select line voltage and the gray level voltage, determine the gray level of the pixel. In an active-matrix LCD, the gray level voltage delivered by the transistor at the pixel determines the gray level.

Both categories of LCDs require light rays from a back light to generate the colors. The back light generates an image plane of light beneath the LCD, which in turn generates the color display. In both passive-matrix and active-matrix systems, the color is generated by an array of color filters.

However, in these LCDs, the following problems are posed. The image quality of active-matrix LCDs is substandard at some contrast settings and viewing angles. Also, image quality changes as the contrast is changed. From a usability standpoint, there exists a considerable amount of dissatisfaction with the contrast and image quality of active-matrix LCDs. Contrast control works on a CRT and users desire that type of interface because they comfortable with it, and the display image is appealing. In a CRT, when the contrast is adjusted up and down it looks good and it adjusts the contrast as one would expect. The contrast control in a CRT is very smooth and very continuous. The situation of the LCD contrast being difficult to adjust in comparison to the CRT is directly related to the fact that an LCD has a limited number of shades of gray, e.g., 64 shades of gray, whereas a CRT essentially has infinite shades of analog. Thus, a need exists to obtain better image quality and better control of the LCD's contrast of the video input to make it more closely resemble or match the quality that is obtained with a CRT when its contrast is adjusted. There is a desire to achieve that parody with an LCD when its video contrast is adjusted. A discussion of manual contrast control of CRTs can be found in most text books, for example, Bernard Grob, *Basic Television Principles and Servicing,* pp. 267–268 ($4^{th}$ Ed. 1975).

LCDs having the above drawbacks are not satisfactorily used in image display devices which are popularly used in avionics and industrial applications, especially in military aircraft; image display devices free from the above drawbacks are desired. To date, some of the attempted solutions to the problem have included classical contrast gain function, digital contrast to input video, and contrast changes. The classical contrast gain function requires brightness as a video adjustment. On LCDs, the brightness of the video is controlled by adjusting the back light. The contrast change solution controls the contrast by selecting from the existing shades of gray as determined by the LCD driver system.

The viewability of an image on an LCD is generally determined by the brightness and contrast of the LCD and video signal corresponding to the image. The luminance of each LCD pixel corresponds to the amplitude of the video signal for the pixel. High amplitudes typically correspond to very bright pixels, while low amplitudes generally correspond to dark pixels. The range between the minimum and maximum amplitudes and the corresponding degrees of luminance may be subdivided into an almost infinite number of luminance levels, reflecting subtleties of shading and color represented by the video signal. The brightness and contrast adjustments of the LCD, on the other hand, are essentially static. Conventionally, brightness corresponds to a direct current signal added to the video signal so that the overall signal level increases. As a result, the overall display becomes brighter. For CRT displays, the DC component is added to the video signal. For LCDs, the backlight system responds to the brightness control.

Contrast, on the other hand, relates to the amplification of the video signal. Thus, as contrast increases, bright pixels become very bright, while relatively dark pixels become only slightly brighter. Generally, the contrast of an LCD is the degree of difference in tone between the lightest and darkest areas in an LCD; contrast is also the subjective assessment of the difference in appearance of two parts of a field of view seen simultaneously or successively. Contrast is a function of liquid crystal molecule alignment, drive voltage, and viewing angle. The user is able to manually adjust the viewability of the picture image through contrast control. The contrast control is a manual control associated with picture-display devices that adjusts the contrast ratio of the reproduced picture/image on the display. The contrast control is normally an amplitude control for the picture signal. The contrast ratio is the ratio of the maximum to the minimum luminance values in an LCD or a portion thereof; in other words, the contrast ratio is the range of brightness between highlights and shadows of the reproduced picture/image on an LCD.

Conventional video displays, such as CRT displays, also typically have a wide dynamic range (i.e., a number of different and distinguishable colors and shades) for displaying each pixel with the appropriate degree of brightness according to the video signal and the brightness and contrast criteria. Small increases in amplitude cause small increases in brightness, regardless of whether the increase is due to a change the video signal or the brightness or contrast control. Consequently, subtle differences in the video signals induce subtle differences in the picture rendered by the display.

In some applications, however, subtle differences are not apparent to the user. For example, in some radar-based imaging applications, the dynamic range or peak-to-peak variation of the video signal information is relatively small. A CRT display shows variations in the video signal as slightly different shades. Where the variations are very small, the differences between different shades in the image may be so slight as to be nearly imperceptible.

This problem is compounded for various modern displays which do not provide the broad dynamic range of CRT displays. Limitations in a display's dynamic range can restrict, or even negate, the display of subtleties in the image. For example, while the dynamic range of various LCDs varies according to type and manufacturer, LCDs generally have a limited dynamic range, particularly in comparison to CRT displays. A typical LCD exhibits a dynamic range limited to, for example, 64 or even 16 shades of gray.

For displays with limited dynamic range, effectively displaying and viewing minor variations in the data or information content is difficult, if not impossible. With limited dynamic range, slight variations in the video signal are commonly lumped into the same shade. As a result, variations in the video signal may not affect the rendered image at all, potentially obscuring vital information. Thus, it would be advantageous to provide a system for utilizing the available dynamic range of a display to enhance the presentation of data.

In view of the foregoing, a need exists for a display architecture capable of controlling the display's contrast over a large dynamic range of video data at high resolution display rates for transmission to the active-matrix LCDs.

BRIEF SUMMARY OF THE INVENTION

The following summary of the invention is provided to facilitate an understanding of some of the innovative features unique to the present invention, and is not intended to be a full description. A full appreciation of the various aspects of the invention can only be gained by taking the entire specification, claims, drawings, and abstract as a whole.

A method for controlling contrast of a liquid crystal display ("LCD") device (either passive-matrix or active-matrix) in which a gray scale is used while receiving large dynamic range of video data to be displayed by the LCD device, the gray scale having a finite number of shades of gray, the LCD device being characterized by a transfer function, the LCD device having a contrast control device for input by a user, the LCD device communicating with a drive voltage generator that supplies drive voltages V to the LCD device, the method comprising the steps of: providing a plurality of look-up tables, the plurality of look-up tables representing a plurality of contrast settings of the LCD device; and selecting a single look-up table from the plurality of look-up tables in response to the contrast setting selected by the user through the contrast control device to affect the transfer function of the LCD device, the single look-up table containing all shades of gray available on the gray scale with each contrast setting. The values of the drive voltages so that all shades of gray are available with each contrast setting. The transfer function is nonlinear and is defined by transmission T as a function of drive voltages V, and wherein the transfer function comprises a plurality of dynamic sets of drive voltages V and is not fixed to a single distribution of gray scale. The contrast setting is a function of a plurality of signals representative of the video data to be displayed by the LCD device, which include digital signals, analog signals, and modulated signals (e.g., pulse-width, amplitude modulated, etc.).

In addition, an apparatus is provided according to the present invention which implements the method of the present invention and includes a memory device containing a plurality of look-up tables, the plurality of look-up tables representing a plurality of contrast settings of the LCD device; and means for accessing the memory device to read or search through the plurality of look-up tables and for selecting a single look-up table from the plurality of look-up tables in response to the contrast setting selected by the user through the contrast control device to affect the transfer function of the LCD device, the single look-up table containing all shades of gray available on the gray scale with each contrast setting. The means for accessing includes, but is not limited to, a processor, counter, programmable logic device, field programmable gate array, a switch that has a counter built into it, either rotary or rocker, etc.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow. The particular values and configurations discussed in this non-limiting discussion can be varied and are cited merely to illustrate an embodiment of the present invention, and are not intended to limit the scope of the present invention.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

Figure 1:
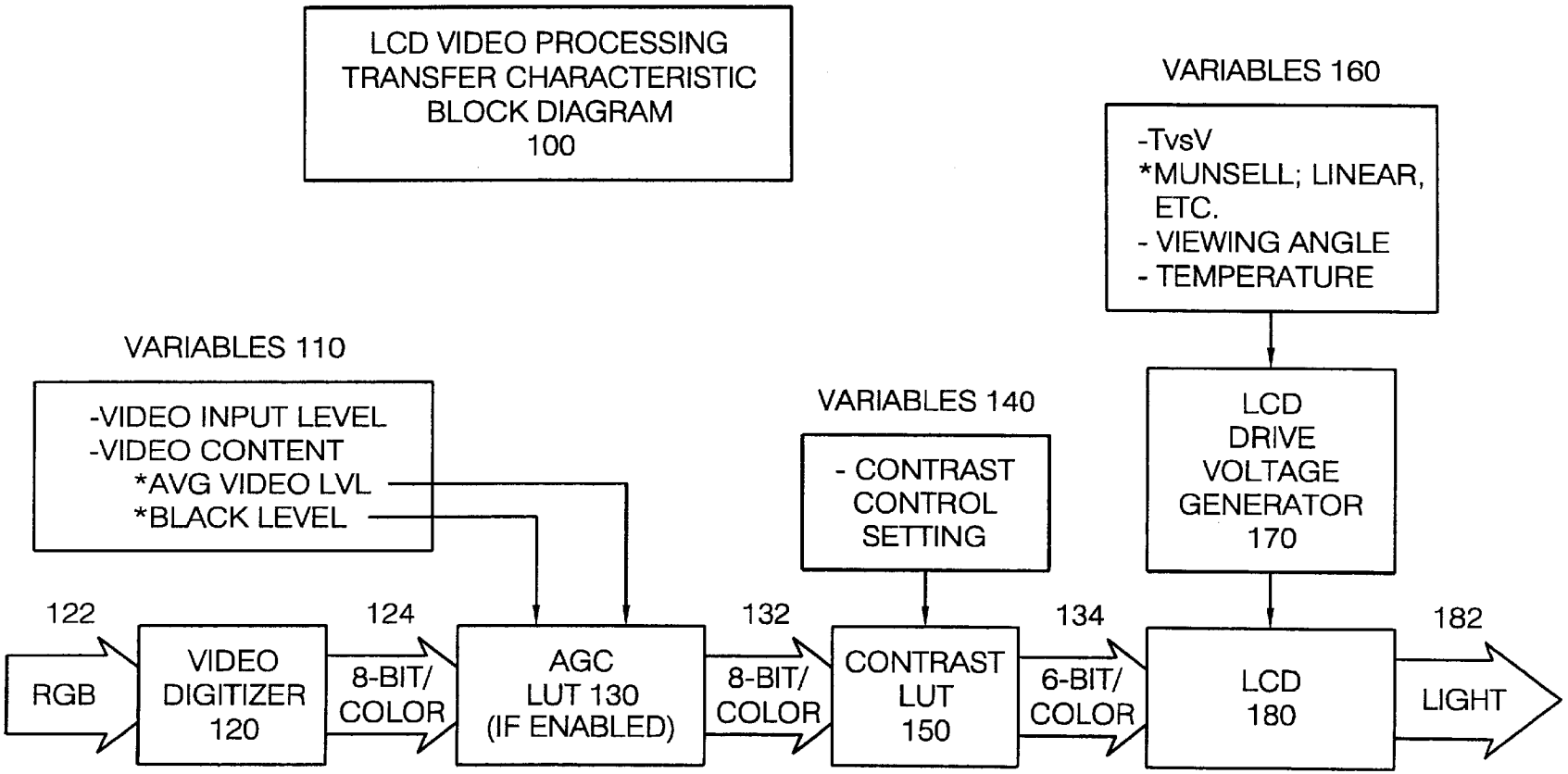
Fig. 1 (PRIOR ART)
FIG. 1 is a high-level transfer characteristic block diagram of a conventional LCD video processing system 100.

The general architecture of an active-matrix LCD device, such as that shown in block 180 of FIG. 1, is well known to those skilled in the art, and an example thereof can be found in U.S. Pat. No. 5,585,951, Active Matrix Substrate, issued to Kazuhiro Noda et al. in its Background of the Invention section but will be discussed in brief for ease of introduction of the present invention. Generally, the architecture of an active-matrix LCD device of, for example, the light transmitting type comprises a liquid crystal composition held between an array substrate and a counter substrate through orientation films. The array substrate comprises a plurality of signal lines and a plurality of scanning lines disposed in a matrix fashion on a glass substrate, with picture element electrodes being arranged through thin film transistors ("TFT") provided as switching elements in the vicinity of respective junctions. In some implementations, additional capacitor lines are also disposed substantially in parallel with the scanning lines on the glass substrate and an insulating film is interposed between the additional capacitor line and the picture element electrode so as to provide an additional capacitor (Cs) between the additional capacitor line and picture element electrode. In other implementations, additional capacitor lines are not required and can use the gate line. Further, in some implementations, the respective signal lines and scanning lines of the array substrate are electrically connected to a driving circuit board through a printed circuit board ("PCB") comprising a polyimide or other flexible substrate and metal wirings formed thereon or a tape automated bonding ("TAB") comprising a printed circuit board carrying driving elements thereon. Moreover, in some implementations, the counter electrode of the counter substrate is electrically connected to the array substrate through a transfer comprising a dispersion of electrically conductive particles. The counter electrode is further electrically connected to the driving circuit board through, for example, the TAB.

Referring to FIG. 1, there is shown a high-level transfer characteristic block diagram of a conventional LCD video processing system 100. System 100 is typical of a PC notebook or ruggedized avionics display implementation. The system 100 operates under a single, fixed set of LCD drive voltages that are supplied by LCD drive voltage generator 170. LCD 180 has a transfer function characteristic, optical or light transmission, T, as a function of drive voltages, V, that is fixed to a single distribution of gray scale, and no user-controlled viewing angle or contrast adjustments is provided. The transfer function of the LCD being optimized is, in a general sense, a video input to the image output (i.e., the light out emitted from the LCD). LCD 180 suitably comprises components typically associated with a display system, such as any required power supply, backlight, control and driver circuitry, memory requirements, and the like.

Automatic gain control look-up table ("AGC LUT") 130 (if enabled, which is determined by the user) receives variable input signals 110, which include video input level and video content (e.g., average video level, black level). Also, AGC LUT 130 receives digitized signals 124 from video digitizer 120. The AGC LUT 130 multiplies the digitized signals 124 by the contrast function, i.e., contrast is a function of gain which translates to a multiplication. When an eight-bit analog video signal is multiplied by an eight-bit contrast gain function in AGC LUT 150, a sixteen-bit answer is obtained. Unfortunately, some LCDs can display only six-bits of information, and thus, some of the video information is lost as a result of rounding and truncating process. As discussed above, LCDs have a limited dynamic range. For example, where an incoming video signal is quantized to 256 shades and the LCD is limited to 64 shades of gray, typical displays lose much of the information in the video signal, or at least render it imperceptible. Accordingly, the present invention (discussed below) analyzes the information content and uses the video signal such that the information is spread over more of the available dynamic range. Spreading or enhancing the information content of the video signal in accordance with the present invention suitably reduces loss of information that would result if the information is displayed over only a few shades of gray (a minor portion of the dynamic range).

Video digitizer 120 receives video data from a signal source (not shown but described in more detail below) and processes the data in a manner well known to those skilled in the art to generate digitized video signals 124. Video digitizer 120 receives separate streams of data from the signal source (not shown) corresponding, for example, to three primary color components, such as red, green, and blue ("RGB") color video signals 122. Video signals 122 are converted to digital signals 124 by video digitizer 120 and provided to AGC LUT 130. Digital signals 124 are conventionally eight-bit words per LCD color in the case of color LCDs. The number of bits per word can vary depending on the application. Contrast LUT 150 receives output signals 132 as inputs. Output signals 132 from AGC LUT 130 are conventionally eight-bit words per primary LCD color in the case of color LCDs. Also, contrast LUT 150 receives variable input signals 140. Input signals 140 include variables such as the setting for contrast control. LCD 180 receives signals 134 from contrast LUT 150. Signals 134 are conventionally four-bit to six-bit words per LCD color depending on the configuration of contrast LUT 150. Of course, those skilled in the art will realize that N-bits per color are possible, where N is an infinite number. For example, the device drivers of contrast LUT 150 can force a truncation of the eight-bit word to less than an eight-bit word, such as a six-bit word as shown, thus losing some of the gray scale information. By truncating the information to a six-bit word, a very coarse adjustment is obtained, which is less than optimal. Also, LCD 180 receives signals 184 from LCD drive voltage generator 170. LCD drive voltage generator 170 receives variable signals 160, which include transmission T as a function of voltage (e.g., Munsell, linear function, a derivative of the linear function, etc.), viewing angle, or temperature. The signals 184 from LCD drive voltage generator 170 are applied to the appropriate portion of the LCD 180 by addressing apparatus normally included in such an LCD device. LCD 180 receives signals 134 and renders a viewable image based on the received data. LCD 180 emits output signals 182 as light to display an image to the viewer.

The signal source discussed above (not shown) provides RGB signals 122 and is any signal source (not shown) that is capable of producing or transmitting a signal, such as a video camera, microprocessor, radar system, infrared scanning system, and/or the like, that can be converted to a video signal. The signal source should be capable of generating any type of signal, for example a digital, analog, or modulated signal representative of the data to be displayed on the LCD. Further, the signal source suitably generates a signal suitable for conversion to viewable data regardless of the nature of the original data, including sensed light or heat, pixel data stored in a computer memory, etc. Conventional video signals 122 typically include a synchronization signal used in some display circuitry to determine transmission loss. Typically, synchronization signal has a specified magnitude, such as 0.286 volts. It should be noted that some single signal sources correspond to a gray scale display having a single stream of data. The present invention is easily applied to a color display system by using three separate streams of data from the signal source (corresponding, for example, to three primary color components, such as red, green, and blue) and combining the streams for presentation at the LCD.

The video signals being provided to the LCD could have a dynamic range (going from 0 volts to full on) that is small, which would correspond to a very small contrast signal. For example, a clear image could be produced by a military tank traveling across a desert that is not much hotter or cooler than the desert temperature, which ever direction the temperature moves. The same information, e.g., the same color on an LCD, would be displayed to the viewer with the exception of a small difference in the overall image at the location of the tank, slightly cooler or slightly hotter on this clear image. A very low dynamic range video signal would be produced as a result. The minimum and maximum points of the video signal are very close to each other. Another example of a dynamic range video signal is seen with a gray ship on the ocean. The gray ship against the blue ocean is not always highly visible, and thus, the dynamic range of those two signals is close as well. The typical range is from zero (no light) to a maximum of light displayed that is essentially infinite. Thus, it is desirable to adjust the contrast to separate the minimum point from the maximum point to make the tank or ship more apparent against the desert or ocean background, respectively. The present invention accomplishes this task of receiving the video signals and controlling contrast.

Figure 2:
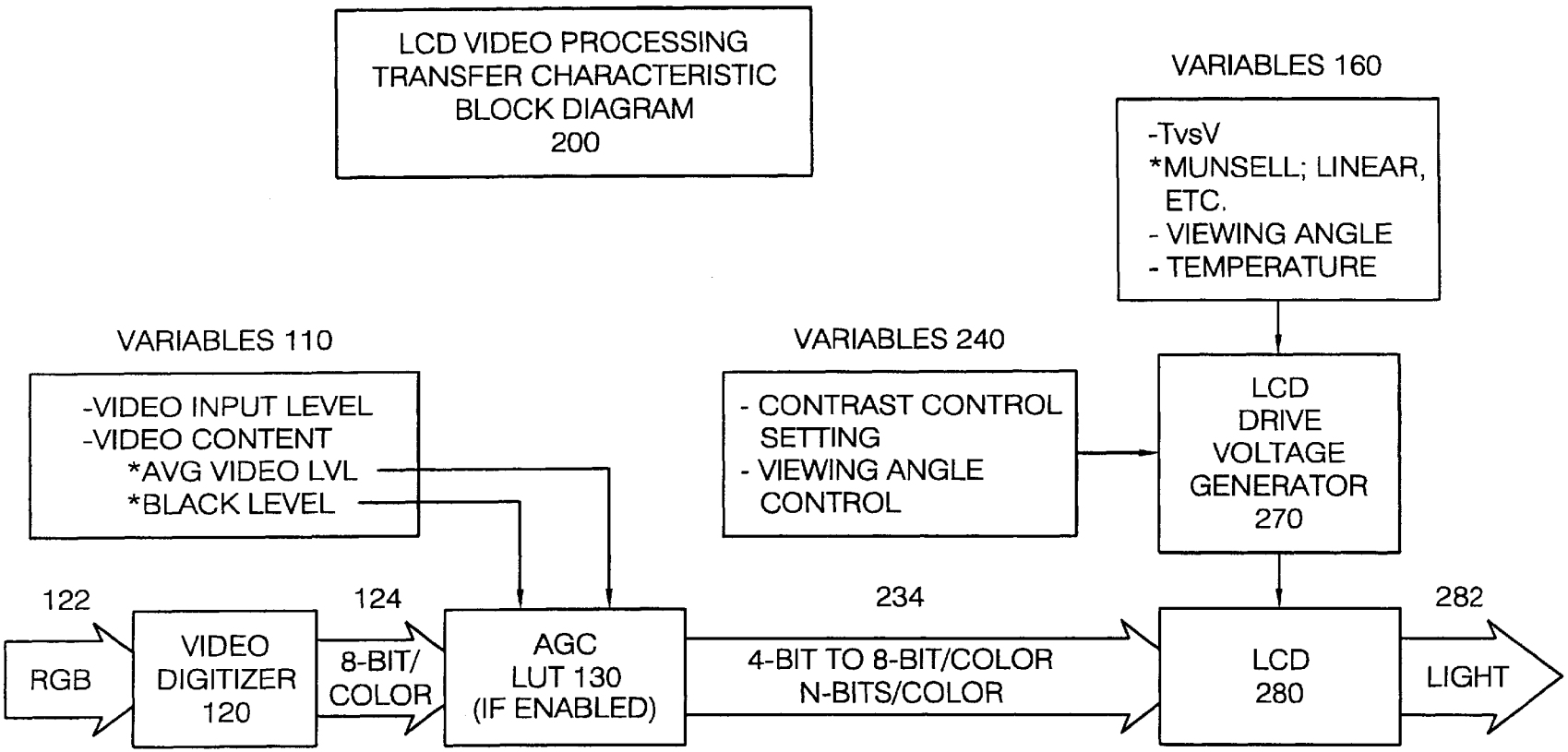
FIG. 2 is a high-level transfer characteristic block diagram of an embodiment of the LCD video processing system 200 in accordance with the present invention.

Referring to FIG. 2, there is shown a high-level transfer characteristic block diagram of an embodiment of the LCD video processing system 200 in accordance with the present invention. The discussion presented above with respect to FIG. 1 applies to FIG. 2 with some structural and functional differences, i.e., where different reference numerals have been used from FIG. 1 to FIG. 2. Those elements that are common to both FIGS. 1 and 2 will not be discussed again except as they relate to the differences in FIGS. 1 and 2. Among other structural and functional differences, one main difference in the conventional implementation shown in FIG. 1 and the implementation of the present invention shown in FIG. 2 is the omission of the contrast LUT 150. Also, the variable input signals 240 of FIG. 2, which include viewing angle control in addition to input signals 140 of FIG. 1, are provided directly to LCD drive voltage generator 270 rather than input to contrast LUT 150 as in FIG. 1. Because the LCD drive voltage generator 270 has inputs other than those shown with respect to voltage generator 170 of FIG. 1, there is a need for additional address lines for LCD drive voltage generator 270 when the present invention is implemented. Also, signals 284 and 282 will be different from their corresponding signals 184 and 182, thus a significantly different LCD drive voltage generator 270 and LCD 280 is produced by the present invention.

As can be seen upon inspection of FIG. 1, the contrast control (contrast LUT 150) in system 100 is implemented in the video path resulting by mapping video gray shades or levels to LCD transmission characteristics, which results in reduced gray scale levels. The reduction in gray scale levels is due to the truncation of the eight-bit words 132, which is a function of the hardware configuration. Thus, some of the information is lost in the transfer between AGC LUT 132 and contrast LUT 150. The present invention does not suffer from this problem. Instead, signals 234 can be, for example, four-bit to eight-bit words per color (the maximum representing all of the video data) depending on the desired accuracy level as opposed to the number of bits in signals 134.

The present invention provides a path for user-controlled viewing angle (contained in signals 160) adjustments as shown in FIG. 2 (signals 240). The present invention also provides a method to enhance video signals through non-linear transfer functions (T versus V) without the aid of the AGC LUT 130, which is does not use the contrast control as in FIG. 1 without the loss of gray scale performance. The present invention provides the same gain functions of the AGC LUT 130 of FIG. 1, but must be manually selected by the user (user in the loop gain control). Unlike the system 100, shown in FIG. 1, the system 200 does not require the AGC LUT 130 to control the gain or multiply the digitized signals 124 by the contrast function in contrast LUT 150, i.e., the contrast LUT 150 function is removed from the video path. The present invention implements contrast control without limiting gray scale availability; the LCD drive voltages are remapped as a function of contrast control. The present invention augments and enhances the AGC LUT function by providing user-adjustable gain characteristics that are independent of the AGC LUT function.

Figure 3:
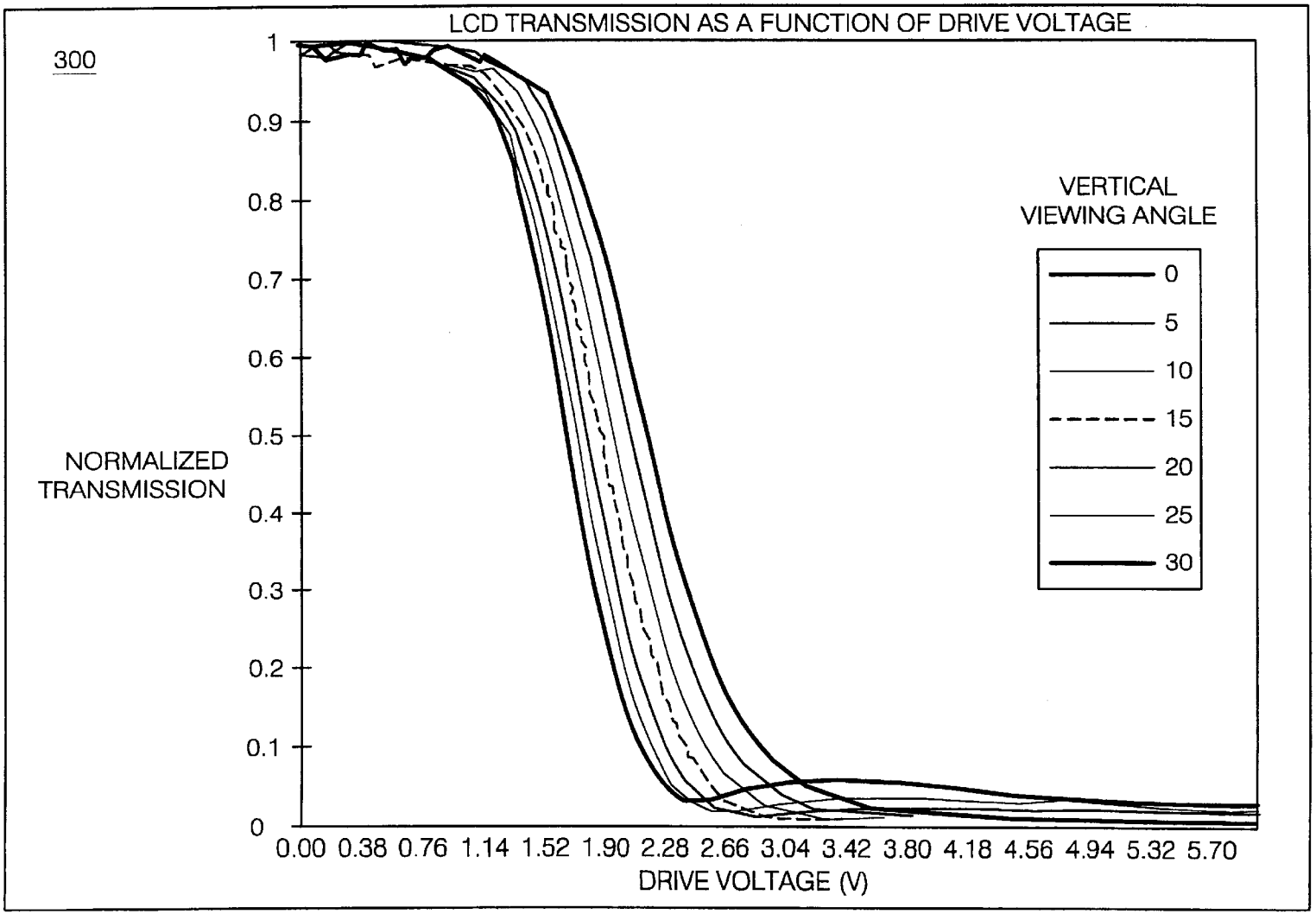
FIG. 3 is a graph illustrating an exemplary relationship between normalized LCD light transmission as a function of drive voltage (applied electric field) at various exemplary vertical viewing angles.

In accordance with various aspects of this embodiment, a finite number of look-up tables are contained in LCD drive voltage generator 270 (there is a finite number of shades of gray in today's LCD). LCD drive voltage generator 270 suitably comprises a programmable read-only memory ("PROM"), although any type of memory (e.g., RAM, ROM, flash memory, etc.) will suffice as will be apparent to those skilled in the art, storing at least one look-up table, suitably containing look-up tables to be applied to adjust the contrast of the LCD. For example, the functions (corresponding to look-up tables) illustrated in FIG. 3 are stored in memory in LCD drive voltage generator 170 for use in adjusting the contrast of the LCD. The look-up tables stored in LCD drive voltage generator 170 can suitably be selected based on the desired contrast as determined by the operator. LCD drive voltage generator 270 selects the desired look-up table from memory, suitably by dynamically maximizing contrast of the LCD device over the dynamic range of the video. LCD 280 has a transfer function characteristic, optical or light transmission, T, as a function of drive voltages, V, that comprises multiple, dynamic sets of LCD drive voltages (optimized for viewing angles and gray scale performance) and is not fixed to a single distribution of gray scale (see FIG. 4 and its discussion). The means for accessing the memory includes, but is not limited to, a processor, counter, programmable logic device, field programmable gate array, a switch that has a counter built into it, either rotary or rocker, or any device that can access and use the stored tables, etc. LCD 280 suitably comprises components typically associated with a display system, such as any required power supply, backlight, control and driver circuitry, memory requirements, and the like.

Referring to FIG. 3, it can be seen from the graph 300 that the excitation (drive voltage) for a selected transmission of light on one look-up table will provide a different transmission of light as compared to a different look-up table and vice versa. FIG. 3 illustrates seven tables as an example, i.e., seven tables representing vertical viewing angles 0, 5, 10, 15, 20, 25, and 30. As can be seen from FIG. 3, the gray scale characteristics of the LCD are non-linear except for a limited region in the mid-transmission range. The operator will typically wish to provide an input signal from settings for a switch or similar apparatus which provide a linear scale. The conversion from a linear input signal to a signal providing a linear transmission of the LCD is typically referred to as the gamma correction to the input signal.

The actual adjustment of the contrast is accomplished by accessing different voltage look-up tables, which are predetermined or generated in advance for each desired contrast setting. The voltage look-up tables are generated by measuring, plotting, and storing the characteristics of the LCD. An exemplary plot of the voltage look-up tables is shown in FIG. 3. The LCD can be either a commercially-available or specially-ordered LCD. The measurements can be made either by the manufacturer of the LCD glass, such as Optical Imaging Systems ("OIS"), or can be made in a laboratory environment by those skilled in the art. The data corresponding to the transmission as a function of drive voltage (and angle) can be obtained by several methods including, but not limited to: (1) manually with a photometer and a protractor; (2) mechanized system with automatic data collection (e.g., a Honeywell Inc. goniometer, which is also offered for sale by OIS and Westar); or (3) using an optical system manufactured by ELDIM in France. The data can be collected by any of these methods.

Currently, there is no source of the data needed for the look-up tables. Thus, in practice, the implementation of the present invention took several weeks worth of collecting and compiling the raw data to arrive at the optimal contrast function. In one embodiment, there were 32 tables corresponding to 32 shades of gray, which required 32 different video inputs to try and optimize the contrast of the LCD.

The viewer controls the contrast by adjusting a contrast control input device, such as a brightness or contrast knob (e.g., clockwise or counter-clockwise) or a rocker switch (e.g., up or down). By adjusting the contrast via a rocker switch, for example, the control system selects a look-up table, which is transparent to the viewer. There is no real limit to the number of look-up tables that can be implemented. The only limitation is the amount of memory available to store the look-up tables, which is not a limitation with which to be concerned in view of the state of memory technology. In practice, the range between 32 to 256 for the number of look-up tables (corresponding to numbers of shades of gray) is adequate but certainly can exceed these numbers in accordance with the present invention; beyond that range, the adjustment in contrast for most applications does not produce a noticeable difference in LCD contrast. For example, 32 different look-up tables can be used to adjust the contrast in some applications, and this number of tables is likely to be adequate.

The present invention receives a large dynamic range of video (i.e., a number of different and distinguishable colors and shades) and controls the contrast settings of an active-matrix LCD by selecting a single look-up table from the different and multiple look-up tables, which are predetermined, rather than using the contrast setting of an active-matrix LCD to select different values from a single look-up table as is the case in conventional applications. Prior to the present invention, the contrast was controlled in discreet value changes along a single table, which represented absolute values for voltage as a function of shades of gray. In the present invention, the single look-up table is selected after locating a suitable contrast in a single table of drive voltages as a function of shades of gray (see, e.g., FIG. 3). The present invention varies the value of the reference voltages of the active-matrix LCD so that all shades of gray are available with each contrast selection. There are 64 shades of gray per primary color plotted in the example shown in FIG. 3, which primary colors are red, green and blue ("RGB"). This makes it possible to fabricate an active-matrix LCD device that exhibits a high image quality and a high contrast.

Figure 4:
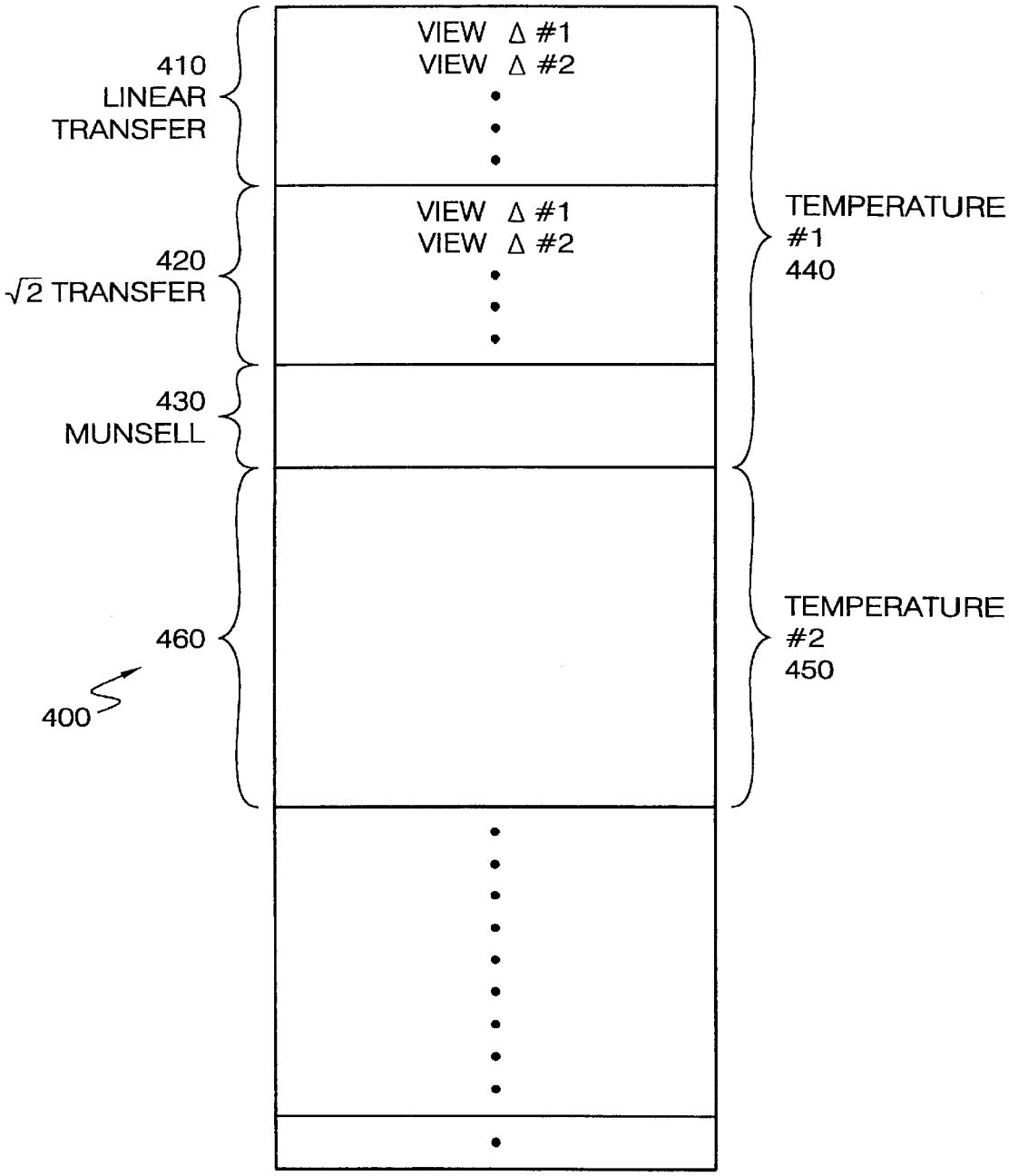
FIG. 4 is a diagram of exemplary look-up tables in accordance with the present invention.

Referring to FIG. 4, there is shown an exemplary architecture of look-up tables in accordance with the present invention. As can be seen from the figure, a plurality of tables 400 up to a number "n" of tables are used to store multiple variables. These tables 400 can include variables such as the multiple viewing angles shown in 410 and 420 that correspond to various LCD operating temperatures. Look-up table 410, corresponding to a first temperature 440, includes, for example, viewing angles as a function of linear transfer 410. Look-up table 420, corresponding to the first temperature 440, includes, for example, viewing angles as a function of the square root of the transfer. Look-up table 430, corresponding to a first temperature 440, includes, for example, viewing angles as a function of Munsell, and so on. Similarly, look-up table 460, corresponding to a second temperature 450, can include other LCD variables and so on. The tables continue up to n tables, where n is an infinite number. Other variables such as drive voltages as a function of gray levels and gamma correction functions can be stored in the look-up tables. The data stored in the look-up tables are then used to provide the user with user-selectable or programmable selections to control the LCD.

Figure 5:
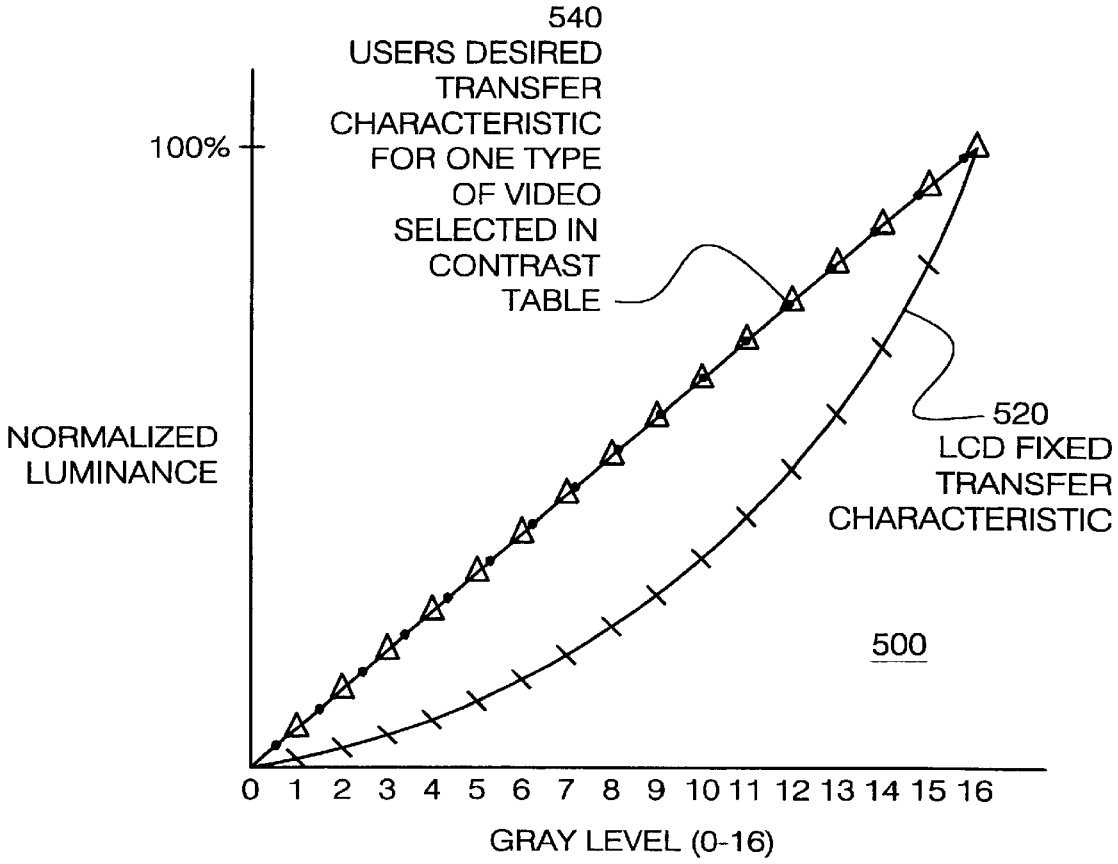
FIG. 5 is a graph illustrating an example of the limitation existing in conventional LCD systems using 16 gray levels.

Referring to FIG. 5, there is shown a graph 500 illustrating an example of the limitation existing in a conventional LCD systems using 16 gray levels with normalized luminance as a function of gray levels. As can be seen upon inspection of FIG. 5 and corresponding Table 1, only 13 of the desired 16 gray levels can be realized because of the fixed transfer characteristics 520. It is the function of the contrast LUT 150 to map the desired transfer characteristics 540 into the available (best fit) gray levels of the LCD. Reference Table 1 below illustrates the fact that the desired gray level differs from the best fit gray level, which causes undesirable contrast control. The present invention does not suffer from this limitation.

| DESIRED GRAY LEVEL | BEST FIT GRAY LEVEL |
|---|---|
| 0 | 0 |
| 1 | 4 |
| 2 | 5 |
| 3 | 6 |
| 4 | 8 |
| 5 | 9 |
| 6 | 10 |
| 7 | 11 |
| 8 | 12 |
| 9 | 12 |
| 10 | 13 |
| 11 | 14 |
| 12 | 14 |
| 13 | 15 |
| 14 | 15 |
| 15 | 16 |
| 16 | 16 |

Reference Table 1. Desired versus Best Fit gray levels.

Figure 6:
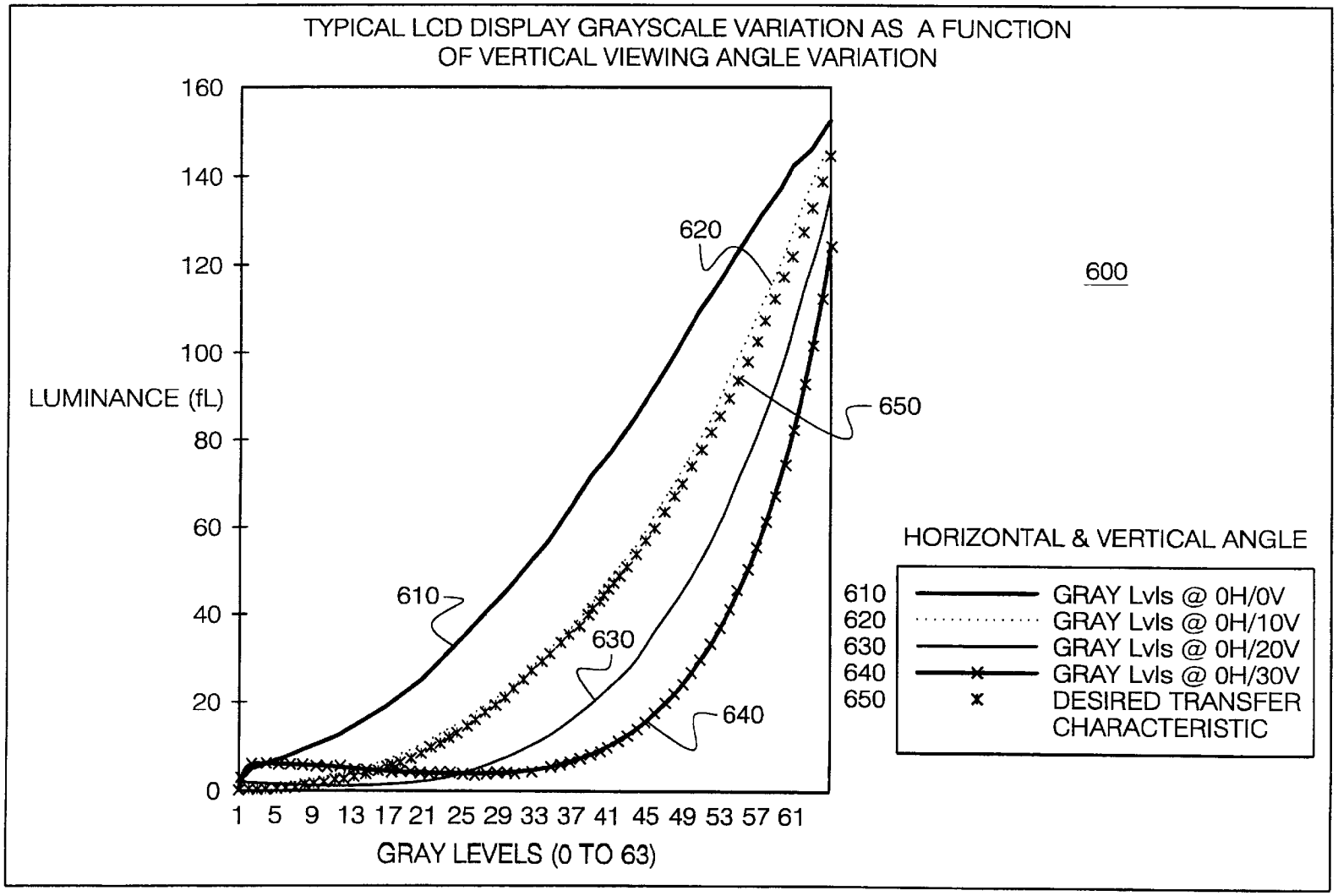
FIG. 6 is a graph illustrating an exemplary LCD gray scale variation as a function of vertical viewing angle variation.

Referring to FIG. 6, there is shown a graph 600 illustrating an exemplary LCD gray scale variation as a function of vertical viewing angle variation. FIG. 6 illustrates five tables as an example, i.e., five tables representing gray levels at a horizontal viewing angle of zero with four corresponding vertical viewing angles 0° (plot 610), 10° (plot 620), 20° (plot 630), 30° (plot 640), and a desired transfer characteristic (plot 650). FIG. 6 illustrates that while performance of the LCD at a horizontal viewing angle of zero and a vertical viewing angle of 10° (plot 620) very closely follows the desired transfer characteristic 650, the display when viewed at other angles does not reflect the proper transfer characteristic. This illustrates the need for the present invention. When the invention is implemented, the desired transfer characteristic can be provided at any of the viewing angles such as those shown.

It is important to note that not all designs of LCDs are provided with sufficient data regarding the LCD transfer function characteristics, which is need to be able to implement the present invention. A very significant amount of data related to the LCD's transfer characteristics must be collected over various temperatures to implement the present invention. Also, a very significant amount of data must be collected to be able to apply a best fit analysis of the curves to the desired transfer characteristics as exemplarily shown in FIG. 6. A detailed knowledge of the LCD, the drivers and the end use of the LCD are required to implement the present invention.

The advantages of the present invention include: allowing the entire dynamic, range of the video to be displayed by using contrast to select different look-up tables; maintaining optimum image quality for all contrast settings by selecting a different set of look-up tables rather than using a subset of an existing, single look-up table; maximizing the use of multiple look-up tables that are already being used to control temperature; and allowing for parts reduction by eliminating contrast control (i.e., contrast LUT 150 in FIG. 1) on the video side. All of the foregoing advantages translate to lower cost, lower power, and higher reliability of the active-matrix LCDs. The present invention provides a very obvious improvement in an LCD's contrast, which was not previously enjoyed.

Although the foregoing description of the present invention has been provided with reference to a light-transmitting type active-matrix LCD device, the present invention is not restricted to this particular type of display. Those skilled in the art will recognize that the present invention is not limited to active-matrix LCD devices of any certain resolution (e.g., 640 by 480 resolution). In this regard, any suitable resolution LCD device can be employed with the appropriate scaling of the various disclosed patterns and circuits. Nor is there any limitation to the use of active-matrix devices. In this regard, the present invention can also be used with any form of passive-matrix devices that are amenable to duty cycle color shading techniques, as well as with multiple or stacked panel arrangements of the color stripe panel. The present invention can also be used with LCD devices having driver arrangements, provided the driver arrangements are capable of being substantially modulated to produce shades of color.

To implement the present invention in a passive-matrix LCD, for example, one skilled in the art would have to collect an extensive amount of data relative to passive-matrix LCDs, viewing angles, and temperature characteristics. The drive methods for passive-matrix LCDs are sufficiently different than the present invention in concept is applicable in practice to active-matrix LCDs, which would have to be considered in the implementation. Also, the passive-matrix LCDs have a very difficult time with video rates. To obtain "near video rates," a scheme known as "Active Addressing" is used, which was developed by Terry J. Scheffer (see, e.g., B. Clifton, D. Prince, B. Leybold, T. J. Scheffer et al., Optimum Row Functions and Algorithms for Active Addressing, SID 93 DIGEST of Technical Papers, 89–92, Vol. XXIV, 1993; U.S. Pat. No. 5,585,816, Displaying Gray Shades on Display Panel Implemented with Active Addressing Technique). The drive voltages to a passive-matrix LCD are derived through a completely different approach and the transmission as a function of voltage is different.

Other variations and modifications of the present invention will be apparent to those of skill in the art, and it is the intent of the appended claims that such variations and modifications be covered. The particular values and configurations discussed above can be varied and are cited merely to illustrate a particular embodiment of the present invention and are not intended to limit the scope of the invention. It is contemplated that the use of the present invention may involve components having different characteristics as long as the principle, the presentation of a selecting a single look-up table from a plurality of look-up tables to process video and control contrast in LCDs, is followed. It is intended that the scope of the present invention be defined by the claims appended hereto.

The embodiments of an invention in which an exclusive property or right is claimed are defined as follows:

1. A method for controlling contrast in a liquid crystal display ("LCD") device in which a full gray scale comprising minimum light out to maximum light out is used with variable video signal input ranges, with each video signal input range comprising a fraction of a total range of zero to full amplitude to be displayed by the LCD device, the full gray scale having a finite number of shades of gray, the LCD device having a contrast control for input by a user, the LCD device communicating with a drive voltage generator that supplies drive voltages V to the LCD device corresponding to the video signal input and a user contrast control setting, the method comprising the steps of:

providing a plurality of look-up tables, the plurality of look-up tables representing a plurality of contrast settings of the LCD device; and selecting a single look-up table from the plurality of look-up tables in response to the contrast control setting selected by the user from the plurality of contrast settings through the contrast control device to affect a transfer function of the LCD device, the single look-up table containing all shade of gray available on the gray scale with each contrast setting.

2. The method of claim 1, wherein the LCD device is an active-matrix LCD.

3. The method of claim 1, wherein the LCD device is a passive-matrix LCD.

4. The method of claim 1, further comprising the step of varying the drive voltages so that all shades of gray are available with a selected contrast setting.

5. The method of claim 1, wherein the step of translating contrast control into a pre-defined transfer function comprises providing a contrast control input into the drive voltage generator.

6. The method of claim 5, wherein the contrast control comprises digital signals.

7. The method of claim 5, wherein the contrast control comprises analog signals.

8. The method of claim 7, wherein the analog signals are a function of the drive voltages.

9. The method of claim 5, wherein the contrast control comprises modulated signals.

10. The method of claim 9, wherein the modulated signals are pulse-width modulated signals.

11. The method of claim 9, wherein the modulated signals are amplitude modulated signals.

12. The method of claim 1, wherein the contrast control is represented by drive voltages as a function of the shades of gray of the gray scale.

13. The method of claim 1 further comprising a plurality of viewing angle controls with respect to the LCD device.

14. The method of claim 1, wherein the plurality of look-up tables are pre-determined.

15. The method of claim 1, wherein the transfer function is non-linear.

16. The method of claim 15, wherein the transfer function is defined by transmission T as a function of drive voltages V, and wherein the transfer function comprises a plurality of dynamic sets of drive voltages V and is not fixed to a single distribution of gray scale.

17. An apparatus for controlling contrast in a liquid crystal display (LCD) device in which a gray scale comprising minimum light out to maximum light out is used with variable video signal input ranges, with each video signal input range comprising a fraction of a total range of zero to full amplitude to be displayed by the LCD device, the gray scale having a finite number of shades of gray, the LCD device having a contrast control for input by a user, the LCD device communicating with a drive voltage generator that supplies drive voltages V to the LCD device corresponding to the video signal input and a user defined contrast control setting, the LCD device comprising:

a memory device containing a plurality of look-up tables, the plurality of look-up tables representing a plurality of contrast settings of the LCD device; and means for accessing the memory device to search through the plurality of look-up tables and for selecting a single look-up table from the plurality of look-up tables in response to the contrast setting selected by the user through the contrast control device to affect a transfer function of the LCD device, the single look-up table containing all shades of gray available on the gray scale with each contrast setting.

18. The apparatus of claim 17, wherein the LCD device is an active-matrix LCD.

19. The apparatus of claim 18, wherein the contrast control input comprises digital signals.

20. The apparatus of claim 17, wherein the LCD device is a passive-matrix LCD.

21. The apparatus of claim 17, wherein the drive voltages vary so that all shades of gray are available with a selected contrast setting.

22. The apparatus of claim 17, wherein said apparatus for translating a contrast setting into a pre-defined transfer function comprises a contrast control input into the drive voltage generator.

23. The apparatus of claim 22, wherein the contrast control input comprises analog signals.

24. The apparatus of claim 23, wherein the analog signals are a function of the drive voltages.

25. The apparatus of claim 22, wherein the contrast control input comprises modulated signals.

26. The apparatus of claim 25, wherein the modulated signals are pulse-width modulated signals.

27. The apparatus of claim 25, wherein the modulated signals are amplitude modulated signals.

28. The apparatus of claim 17, wherein the contrast settings are represented by drive voltages as a function of the shades of gray of the gray scale.

29. The apparatus of claim 17 further comprising a plurality of viewing angle controls with respect to the LCD device.

30. The apparatus of claim 17, wherein the plurality of look-up tables has contents that are pre-determined.

31. The apparatus of claim 17, wherein the transfer function is non-linear.

32. The apparatus of claim 31, wherein the transfer function is defined by transmission T as a function of drive voltages V, and wherein the transfer function comprises a plurality of dynamic sets of drive voltages V and is not fixed to a single distribution of gray scale.

33. A method for controlling contrast in a liquid crystal display ("LCD") device in which a gray scale comprising minimum light out to maximum light out is used with variable video signal input ranges, with each video signal input range comprising a fraction of a total range of zero to full amplitude to be displayed by the LCD device, the gray scale having a finite number of shades of gray, the LCD device having a contrast control for input by a user, the LCD device communicating with a drive voltage generator that supplies drive voltages V to the LCD device corresponding to the video signal input and user defined contrast control setting, the method comprising the steps of:

providing a plurality of look-up tables, the plurality of look-up tables representing a plurality of contrast settings of the LCD device; and selecting a single look-up table from the plurality of look-up tables in response to the contrast setting selected by the user from the plurality of contrast settings through the contrast control device to affect a transfer function of the LCD device, the single look-up table containing all shades of gray available on the gray scale with each contrast setting, wherein the transfer function is non-linear and is defined by transmission T as a function of drive voltages V.

* * * * *